United States Patent [19]

Austin

[11] Patent Number: 4,936,488

[45] Date of Patent: Jun. 26, 1990

[54] BEVERAGE DISPENSING VALVE

[75] Inventor: Forrest L. Austin, Brooklyn Center, Minn.

[73] Assignee: The Cornelius Company, Anoka, Minn.

[21] Appl. No.: 60,783

[22] Filed: Jun. 10, 1987

Related U.S. Application Data

[60] Continuation of Ser. No. 784,923, Oct. 4, 1985, abandoned, which is a division of Ser. No. 415,505, Sep. 7, 1982, Pat. No. 4,549,675.

[51] Int. Cl.[5] ..... B67D 5/56

[52] U.S. Cl. ..... 222/129.1; 251/149.9; 285/26; 285/317

[58] Field of Search ..... 222/129.1; 137/607, 137/614.06; 251/149.9; 285/24–29, 137 R, 305, 317; 403/13, 14, 317, 330

[56] References Cited

U.S. PATENT DOCUMENTS

| | | | |
|---|---|---|---|
| 2,965,396 | 12/1960 | Reynolds et al. | 285/137.1 |
| 3,864,048 | 2/1975 | Parker | 403/13 X |
| 3,902,636 | 9/1975 | Zilk | 222/129.1 |
| 4,474,492 | 10/1984 | Fleitas | 403/14 X |
| 4,496,079 | 1/1985 | Verley | 137/607 X |
| 4,557,261 | 12/1985 | Rugheimer | 285/317 X |

*Primary Examiner*—F. J. Bartuska
*Attorney, Agent, or Firm*—Henry C. Kovar

[57] ABSTRACT

A beverage dispensing valve primarily for post-mix has a valve body that will accept all known types of beverage flow controls, water and syrup valves that are interchangeable in either of two fluid ports, a reversible block between the valves and a nozzle that enables syrup to be used in either port and water to be used in either port, a positively sealing and easily removable nozzle for improved sanitation and mixing, and multiple fulcrums in the valve body that will respectively accept a manual actuator or a switch actuator and a solenoid driven actuator. A receiver on the valve body accepts a single solenoid for both valves and an electronic dispensing control which is restrained in place by a removable cover, a finger pad in the valve actuator provides manual override for electrical component failure, an alternate actuator opens the water valve only regardless of which side the water valve is in and regardless of whether the dispensing valve is manual or electric, the water and syrup valves are pallet type valves positioned horizontally and the valve actuator goes over the top of the valves to reach forward located valve anvils and reduce the size of the dispensing valve, and a manifold and latch mechanism provide either quick disconnect or manually disconnectable mounting of the valve body.

6 Claims, 9 Drawing Sheets

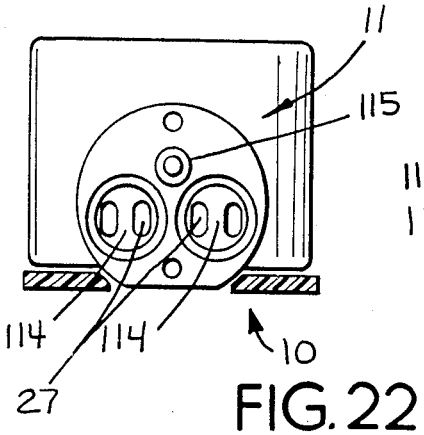
FIG. 22
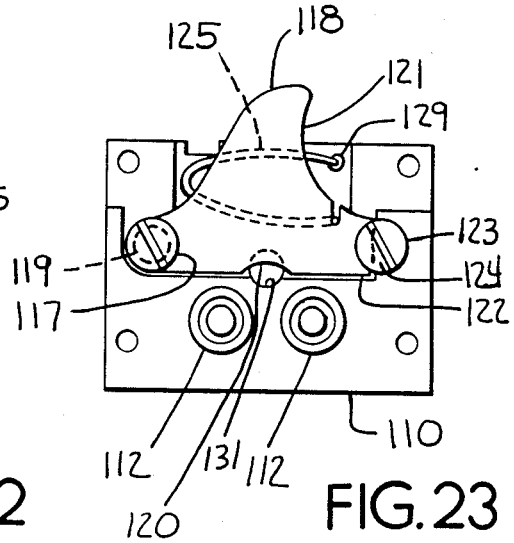
FIG. 23
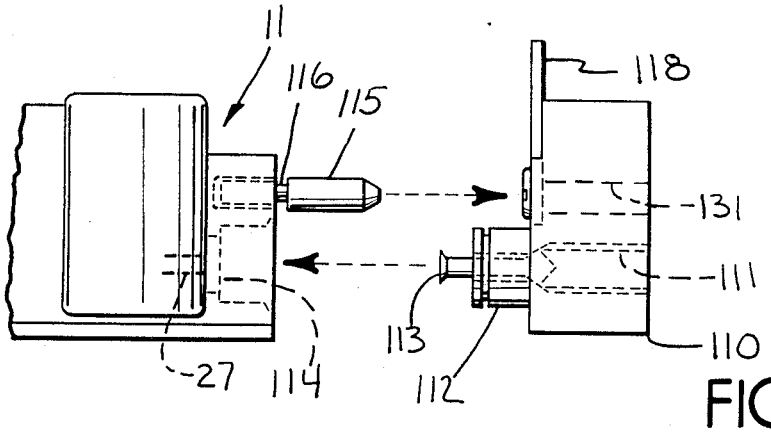
FIG. 24
FIG. 25
FIG. 26
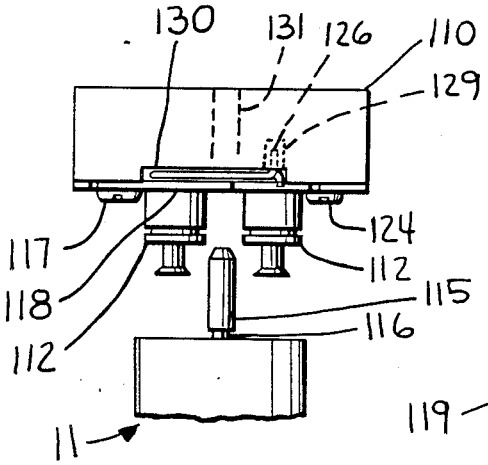
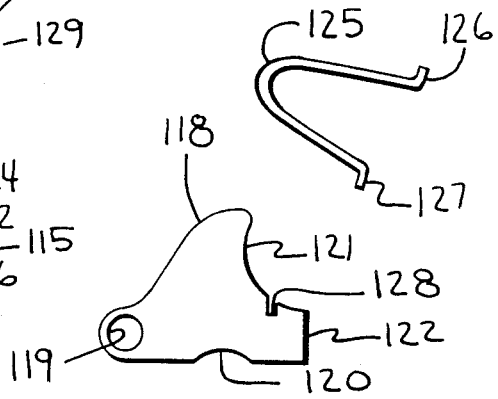

BEVERAGE DISPENSING VALVE

This application is a co-pending continuation application based upon U.S. Ser. No. 784,923 filed Oct. 4, 1985 which is now abandoned and which was a co-pending divisional application based upon U.S. Ser. No. 415,505 filed Sept. 7, 1982, now U.S. Pat. No. 4,549,675.

BACKGROUND OF THE INVENTION

FIELD OF THE INVENTION

This invention pertains to a beverage dispensing valve having an improved construction and several new improvements.

THE PRIOR ART

There are a great quantity of prior examples of beverage dispensing valves, both in pre-mix and post-mix embodiments. Pre-mix beverage is finished beverage made at a bottling plant and is the same as bottled or canned beverage; a pre-mix beverage dispensing valve has one fluid line and usually has some kind of device to effect a gradual pressure drop for preventing foaming. Post-mix beverage is a different practice. In post-mix, a syrup concentrate is combined with water during dispensing. A post-mix dispensing valve has two fluid lines, one for syrup and the other for water. Each fluid line has a normally closed valve element and there's usually a mix spout downstream of the two valve elements. In the U.S., the commercial manufacturers of pre-mix valves are Cornelius and Hausen; Cornelius, Alco, Booth, K-Way, Flowmatic, McCann, Multiplex, and Concession services are manufacturers of post-mix dispensing valves.

Existing post-mix beverage dispensing valves are quite extensive in form and construction. Each valve example has its good and bad points. Each valve seems to have a unique capability that other valves do not have. All of the known to be desirable features are not available in a single valve. There is a valve that is disconnectible, there is a quick disconnect valve, there are electric valves, there are manual valves, there are valves that have a nozzle that comes off, there are valves that have a separate actuator for dispensing only water, there are valves that have electronic dispensing controls with or without portion control, and there are valves with built-in flow controls. But, there is no single valve that has all of these. If a business needs different features for different retailing locations, different valves must be used and spare parts and service needs double and triple and so forth.

Drink temperature is a problem. A "random draw" is a drink dispensed after a dispenser has been sitting idle, or the first drinks when the business opens up. The physical mass of existing post-mix valves effects substantial heat transfer and warm-up of beverage in the valve and upstream from the valve, and random draw drinks are typically too warm and unacceptable. During extended draw dispensing, electric solenoids heat up and make the valve body too warm which adversely affects dispensing temperatures. In some valves, the beverage ingredients actually come in contact with the armature of the solenoids.

Virtually all valves that have electronic controls have had the control added on as an after-market accessory. None of the known adaptations are other than makeshift.

Most electric valves use two solenoids, one each for water and syrup. If either fails, the business is shut down as there is no manual override available for either solenoid, switch or electronic control failure. The use of two solenoids also doubles the failure probability and replacement of a solenoid which is in the beverage stream requires a break-open of the sealed beverage system. The use of a solenoid armature in actual contact with the beverage has given substantial metallic and/or sulfur off-taste problems in dispensed beverages.

Different valves have been required for different soft drink brands. Post-mix valves typically have side-by-side syrup and water ports and Coca-Cola has their syrup on the right side and their water on the left side. Pepsi-Cola and most other brands have their syrup on the left and their water on the right side. Other lesser and house brands couldn't care less about which side; they select the arrangement they personally prefer, taking into consideration the capability of the equipment they have. None of the known post-mix valves are capable of handling syrup and water in either side; the known valves are either right syrup only or left syrup only.

Disassembly for sanitation of the nozzle and syrup distributor is a problem. Some valves require tools for removal of the nozzle, some valves have nozzles that become stuck to the valve, and some have fastened in syrup distributors that are difficult and/or messy to remove. So, they aren't cleaned.

The existing electric post-mix valves are quite large, they are relatively heavy and consume a great amount of raw material such as plastic and wiring. They also must be spaced apart from one another a greater distance than is desirable particularly when compared to the lesser spacings required for pre-mix or manual post-mix valves.

The known post-mix valves do not have the capability of being all of manual, electric switch actuated, electronic control actuated and controlled, nor do they have the capability of being used in an alternative mode in the case of electrical or electrical component failure. These valves cannot be all of fixed, quick disconnect or disconnectable, and they cannot internally accept all of the various liquid flow controls including rubber washer, needle valve and adjustable flow control. The existing valves will not dispense at the accepted standard rate of 1.5 oz/sec and also at the present contemporary high-flow rate of 3.0 oz/sec.

Most of the existing post-mix valves utilize remote flow controls or have flow controls in the valve which are too small to be useful for the high flow rates or else are excessively sensitive because of their small size.

Insufficient strength of quick disconnects on beverage valves has been a problem. The disconnectable valves have taken too long to operate and are too large in physical size.

In the existing electronic valves, removal of the cover disturbs and moves the electronic control.

Accessibility for adjustments has been a problem. Various valves have adjustable devices that require access from above and below and from the front and from the side; these adjustments may also require special tools and/or a variety of tools.

OBJECTS OF THE INVENTION

It is an object of the present invention to provide an improved beverage dispensing valve.

It is an object of the present invention to provide a post-mix beverage dispensing valve having a single actuator with adjustable hammers for contacting and opening liquid valves It is an object of the present invention to provide a beverage dispensing valve having an improved actuator hammer for opening the valve elements.

It is an object of the present invention to provide an improved construction of a beverage dispensing valve.

It is an object of the present invention to provide a beverage dispensing valve having improved adjustability of valves, flow controls and other adjustable components.

It is an object of the present invention to provide a beverage dispensing valve of compact construction having actuators above the valve elements.

It is an object of the present invention to provide a beverage dispensing valve having an improved mount for an electronic control.

It is an object of the present invention to provide a beverage dispensing valve of the post-mix type which has an improved actuator for alternate dispensing of only water.

It is an object of the present invention to provide a beverage dispensing valve of the post-mix type which can dispense water in either of two discrete passageways, and syrup in either of these passageways.

It is an object of the present invention to provide a beverage dispensing valve having an easily removable syrup diffuser held in place by an easily removable dispensing nozzle.

It is an object of the present invention to provide a beverage dispensing valve having an improved sealing structure between a valve body and an easily removable nozzle.

It is an object of the present invention to provide a beverage dispensing valve having an improved quick disconnect structure.

It is an object of the present invention to provide a beverage dispensing valve of the disconnectable type having an improved positive locking and shut=off structure for dispensing and removal respectively.

It is an object of the present invention to provide a beverage dispensing valve that can do many more functions than any other valve.

It is an object of the present invention to provide a beverage dispensing valve of a new construction that reduces size and increases the quantity of functions that the valve can do.

It is an object of the present invention to provide a beverage dispensing valve that can dispense beverage at either standard or high flow rates.

It is an object of the present invention to provide a beverage dispensing valve that dispenses a colder randomly drawn drink.

It is an object of the present invention to provide a basic construction of a beverage dispensing valve that can be actuated manually, electrically, by an electronic control, or that can be semi-permanently connected, disconnectable or quick disconnectable.

It is an object of the present invention to provide a beverage dispensing valve that can be mounted closer together with like dispensing valves.

It is an object of the present invention to provide a beverage dispensing valve having electronics that are not disturbed when a cover of the valve is removed.

It is an object of the present invention to provide a beverage dispensing valve for post-mix that is smaller and lighter and which therefore uses less natural resources for its manufacture.

It is an object of the present invention to provide a post-mix beverage dispensing valve having a basic functional body and valve element construction that enables it to be any permutational combination taken from the actuation types of manual, electric, electronic control, water only, and manual override, and from the flow control types of rubber washer, needle valve, adjustable automatic compensating, fixed orifice, and extended passageway, and from the connector types of fixed, quick-disconnect, or manually disconnectable, and from the flow rates of either present or contemporary high-flow, and which will accommodate syrup on either side and water on the other of either sides of the dispensing valve, and which will utilize a single electric solenoid when electric for any selected permutational combination.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

SUMMARY OF THE INVENTION

A post-mix beverage dispensing valve having a valve body, two fluid ports, a water valve in one port and a syrup valve in the other port has the discrete new features of a common actuator hammer having a single fulcrum in the valve body and a pair of adjustable hammer heads carried by the hammer for connecting the hammer to valve anvils;

an actuator hammer pivotally mounted in the valve body and reaching over the top of the valves and the valve body to in front of the valve body to reach and make contact with forward extending valve anvils;

valve actuators that extend forward from each valve, a manual valve actuator pivotally supported by the valve body, and hammer on the actuator, the hammer being in front of the valves and being operatively engageable with both valves;

horizontal and upward facing valve seats in each port with water and syrup valves on top of the seats, valve actuator anvils extending forward of the valves, a fulcrum in the valve body and above the valves, and a common actuator hammer for opening both valves, the hammer being above the valves and the anvils and having a pair of hammerheads forward of the valve body;

a water valve actuator independently operable of a common actuator hammer, the water valve actuator having a structure for engaging only the water valve regardless of which side of the valve body the water valve is in;

a reversible block between a main valve body and a dispensing nozzle, the block having a syrup port and a water port that are symmetrical and centered with respect to the main valve body;

an improved sanitary dispensing outlet in which a syrup diffuser is slip-fitted into a syrup port outlet and held there by an easily removable nozzle which has retainers lockable to a valve shroud; and an improved seal for a removable dispensing nozzle in which the nozzle has retainers holding it to a valve shroud, with there being a stationary fixed seal about syrup and water outlet ports, and a concave frusto-conical surface in the top of the nozzle for engaging the seal.

Another aspect of the present invention is an electronically operable beverage dispensing valve having a receiver in a valve body, an electronic control connected to a dispensing solenoid and removably mounted in the receiver, and a removable valve cover that fixes the control in the receiver.

A further aspect of the present invention is an improved quick disconnect beverage dispensing valve having a disconnect latch journaled by a pivot pin and having an opposed retainer end held under a retainer pin, the latch has a unique finger receiving trigger, and a U-shaped hairpin spring biasing the latch into a locked position.

A still further aspect of the present invention is an improved disconnectable beverage valve having a fixedly mountable manifold to which a valve body is removably retained; the manifold has a valve locking latch, a manually openable shut-off valve that can be opened only when a lock bolt is holding the latch in the locked position.

BRIEF DESCRIPTION OF THE DRAWINGS

FIG. 22 is a rear elevational view of the dispensing valve of FIG. 1.

FIG. 23 is a front elevational view of a quick disconnect mounting manifold for the dispensing valve of FIG. 1.

FIG. 24 is a side elevational view of the valve of FIG. 1 being joined to the manifold of FIG. 23;

FIG. 25 is a top plan view of FIG. 24;

FIG. 26 is a detail of the latch and spring on the manifold of FIG. 23;

AS SHOWN ON THE DRAWINGS

Figure 1:
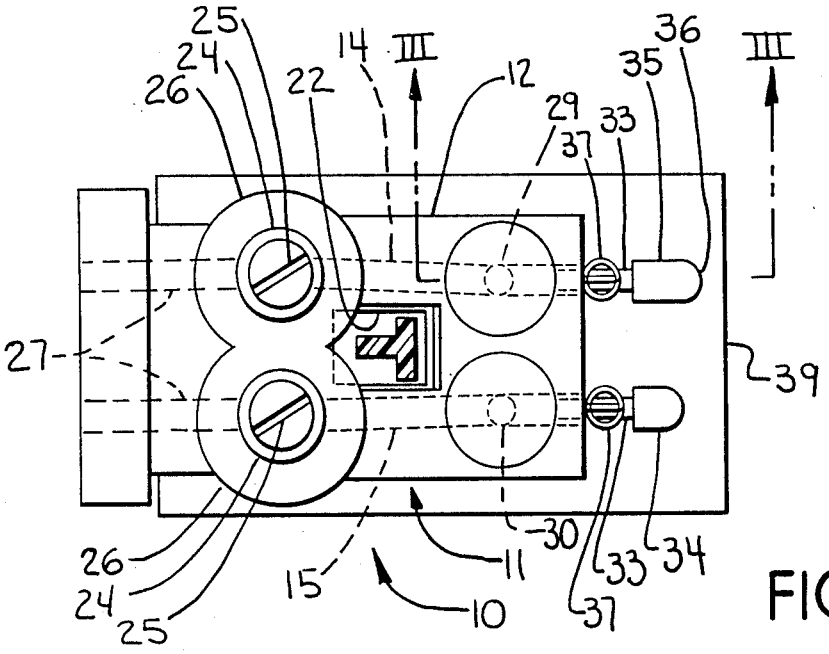
FIG. 1 is a top plan schematic view showing the general arrangement of the basic elements of a beverage dispensing valve according to the present invention.
Figure 2:
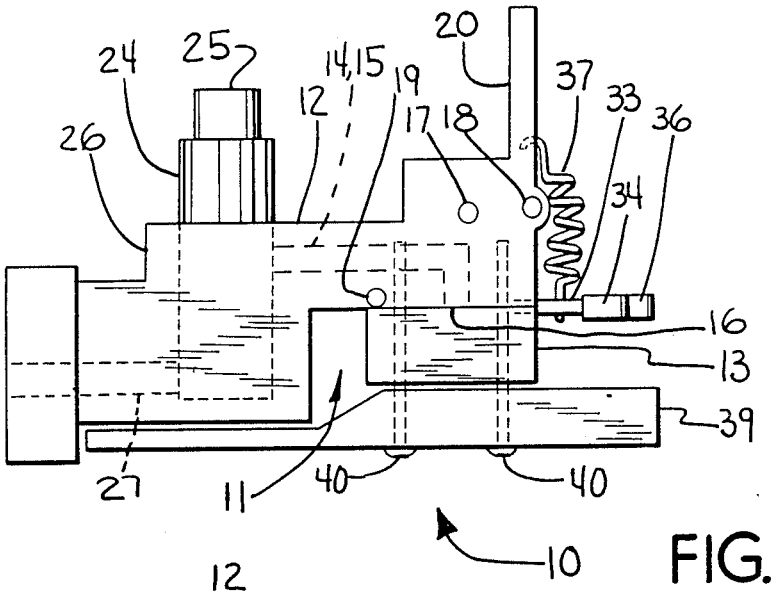
FIG. 2 is a side elevational view of the valve of FIG. 1.
Figure 3:
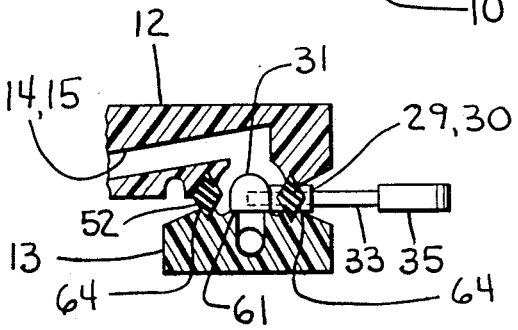
FIG. 3 is a side elevational sectional view of the normally closed valve element used for either water or syrup in the dispensing valve of FIG. 1.

The principles of the present invention are particularly useful when embodied in the beverage dispensing valve shown in FIG. 1 and generally indicated by the numeral 10.

The dispensing valve 10 has a valve body generally indicated by the numeral 11 that includes a main body 12, a valve block 13, a water valve 29 and a syrup valve 30. The main body 12 has a first fluid port 14, a second and transversely located fluid port 15 and a downward facing horizontal surface 16 through which the ports 14, 15 extend. The valve body 12 has three actuator fulcrums; a first fulcrum 17 is for a manual actuator, a second fulcrum 18 is for a solenoid driven actuator and a third fulcrum 19 is for a switch actuating lever. On top of the body 12 is a receiver 20 for a solenoid and for an electronic control that will fit into a mortise 21 of the receiver 20. An actuator port 22 extends through the body 12 in between the fluid ports 14, 15 for a mechanical valve actuator. In the back of the body 12 are upright cylinders 26 for accepting cartridge type flow controls 24, each flow control 24 preferably having an upward facing adjustment screw 25. The fluid ports 14, 15 each have a discrete fluid inlet 27 into and adjacent a bottom of the respective cylinder 26 and the fluid ports 14, 15 exit from adjacent the top of the cylinders 26. The cylinders 26, and fluid ports 14, 15 with inlets 27 are identical mirror images of one another and the flow control cartridges 24 are interchangeable between the ports 14, 15. Specifically, the flow controls 24 come one for water and one for syrup. Either flow control 24 can be placed in either of the cylinders 26 and therefore either of the ports 14, 15. The adjustable flow control 24 having the adjustment screw 25 is the best available and most expensive of commercially used beverage flow controls and is typically of a known piston with a sleeve type having a spring between the piston and the adjustment screw 25. There are many other known and used types of flow controls, specifically collapsible rubber washer, needle valve, fixed orifice, and elongate small diameter passageways equivalent to a length of small diameter tubing. All of these forms of flow controls have been structured into standard flow water, high flow water, standard flow syrup, and high flow syrup, and have further been structured into flow control cartridges 24 that are interchangeable in either cylinder 26 and therefore in either of the ports 14, 15. In all embodiments, the adjustment screw 25, whether for a piston type, needle valve or other type of flow control, has its engageable means such as a slot hex head, special key and the like extending upwardly so that it is accessible and adjustable from above. Both fluid ports 14, 15 are sized sufficiently large to be able to handle relatively high flow rates of either water or syrup. By way of explanation, standard flow rates have been 1.5 oz/sec and high flow rates have been 3.0 oz/sec of beverage; the flow rates of beverage constituents, water and syrup are each less and variable depending upon the concentration ratio of the syrup which can be anywhere from 3:1 to 9:1.

The water valve 29 and syrup valve 30 are of a type called a pallet valve, the valves 29, 30 are positioned horizontally and are identical to each other and are interchangeable with each other and can also be used interchangeably in either port 14, 15. Each of the valves 29, 30 has an elastomeric valve head 31 inside of a circular seal 32 shown having a diamond cross section. A rigid lever type actuator 33 extends out of the valve head 31 forward through the valve seal 32 to a position forward of the valve body 11. The syrup valve 30 has a plastic actuator anvil 34 on the front of its actuator 33 and the water valve 29 has a plastic actuator anvil 35 on its actuator 33. The water actuator anvil 35 has on its front end a nose 36 that makes the water actuator anvil 35 project forward of the syrup anvil 34 for reasons that will be explained. A spring 37 is mounted in tension between the valve body 12 and each actuator 33 for closing each respective valve 29, 30.

Underneath the main body 12 and valve block is a lower shroud 39 which is fastened to the body 12 by screws 40; the block 13 is sandwiched in compression between the main body 12 and the valve block 13. The shroud 39 has an opening in registry with the body actuator port 22 for an actuator to extend therethrough.

Figure 4:
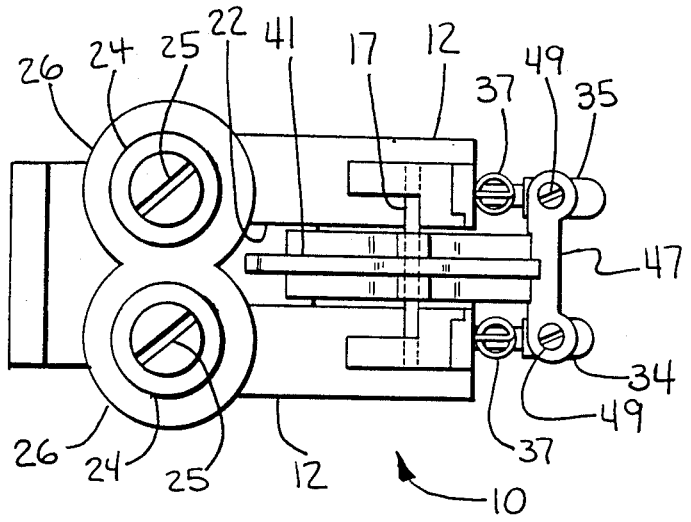
FIG. 4 is a top plan view of the valve of FIG. 1 showing a manual valve actuator.
Figure 5:
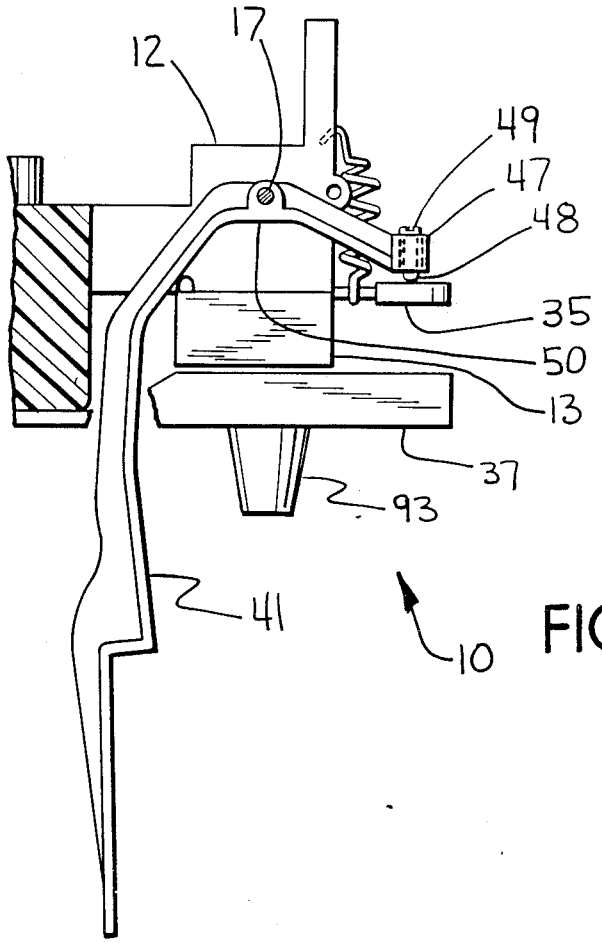
FIG. 5 is a side plan view of FIG. 4.

FIGS. 4 and 5 show the mechanical manual actuator 41 in place and operative upon the valve body 12 to complete a beverage dispensing valve 10 that will function without electricity while deriving its power from a manual effort. This is commonly referred to as a "manual valve". The manual actuator 41 is pivotally mounted to the main body 12 by a single and first fulcrum 17. The manual actuator 41 has on its forward extension from the fulcrum 17, a common hammer 47 having hammerheads 48 for contacting and driving the anvils 34, 35 downward for opening the valves 29, 30. Each hammerhead 48 has an adjustor 49 having its adjustment slot or hex facing upward enabling adjustment from above the dispensing valve 10. The common hammer 47 is T-shaped and the valve closing springs 37 are one each between a respective arm of the common hammer 47 and the main body 12. Each of the hammerheads 48 is adjustable for giving simultaneous opening of the valves 29, 30 in proper relation to an angular position of the downward extending leg of the manual actuator 41. The manual actuator fulcrum 17 is in the main body 12 and is mounted directly above the port outlets 23, the valves 29, 30, the valve block 13 and the nozzle 93. The manual actuator 41 reaches from below and in back of these elements and up and over the top of them to reach the actuator anvils 34, 35, which are forward of the valves 29, 30. The manual actuator 41 is in the general form of an inverted-U which extends as an arch 50 over the valves 29, 30, valve block 13, and the nozzle 93, and the actuator 41 extends downwardly in both the front and the rear of the fulcrum 17. The water anvil 35 extends forward of the hammerheads 48 for purposes which will be explained.

Figure 6:
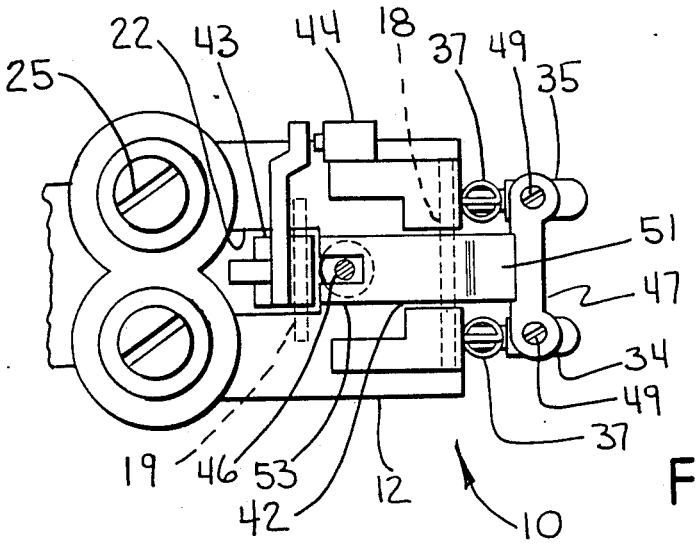
FIG. 6 is a top plan view of the dispensing valve of FIG. 1 showing an electro-mechanical actuator.
Figure 7:
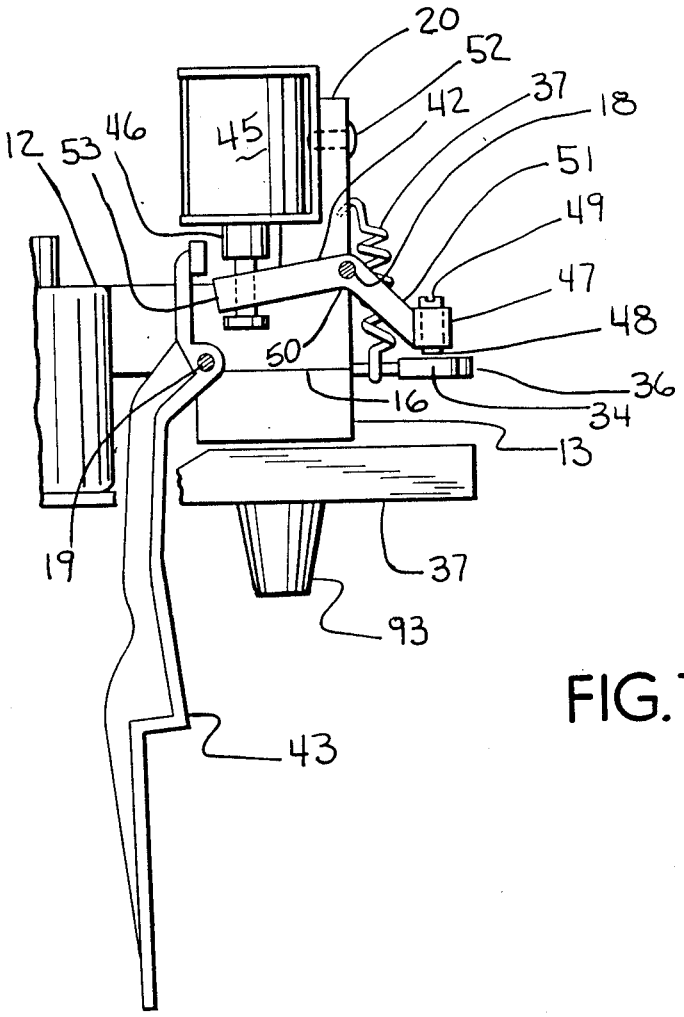
FIG. 7 is a side view of the dispensing valve of FIG. 6.
Figure 8:
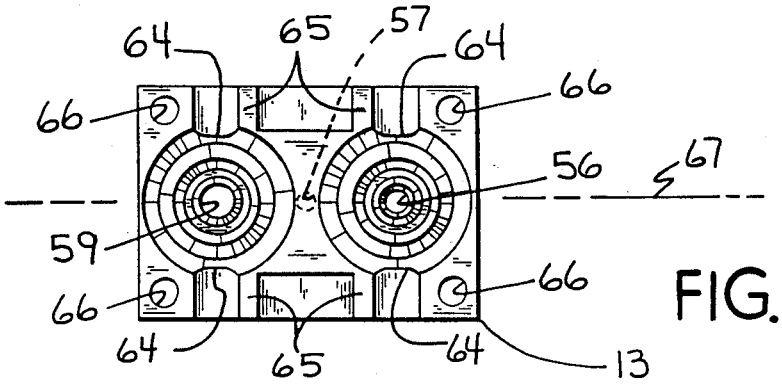
FIG. 8 is a top plan view of a reversible outlet block for the dispensing valve of FIG. 1.
Figure 9:
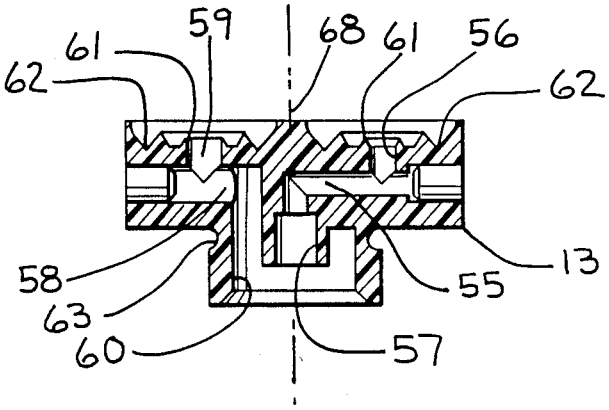
FIG. 9 is an elevational sectional view of the block of FIG. 8.

FIGS. 6 and 7 show the beverage dispensing valve 10 having an electric solenoid 45 actuatable by a solenoid switch 44 which is operable by a switch actuator 43. The solenoid 45 is mounted invertedly to the receiver 20 of body 12 by screws 52 and is positioned with its axis being vertical and faced downward so that the armature 46 free-falls downwardly. The solenoid 45 and its armature 46 are both above and isolated from the beverage ports 14, 15 so that heat from the solenoid 45 goes up away from the ports 14, 15 and valve body 11, and so that there is no contact with beverage ingredients by the solenoid 45. The solenoid 45 is connected to the valves 29, 30 by a solenoid actuator 42 which also has a common actuator hammer 47, hammerheads 48 and adjustors 49 just like the manual actuator 41. The solenoid actuator 42 is pivotally mounted to the second fulcrum 18 which is in the main body 12 above the valves 29, 30, valve block 13 and nozzle 93. The front of the solenoid actuator 42 has a finger pad 51 in between hammerheads 48, which is for manual actuation of the common hammer 47 and of the dispensing valve 10 in the event of power failure, switch failure or solenoid failure. The solenoid actuator 42 has a fork 53 in back of the fulcrum 18 which positively connects into the solenoid armature 46. The coil of the solenoid 45 is replaceable by unfastening the screws 52. The solenoid actuator 42 has an inverted V-shape with the connection of the solenoid armature 46 to the fork 53 being at a level below the fulcrum 18. The high point of each of the actuators 41, 42 is considered to be the arch 50, and therein is the respective fulcrum 17, 18 for each actuator 41, 42.

The switch actuator 43 is pivotally mounted in the third fulcrum 19 which is also in the main body 12. The fulcrum 19 is a pin held in the main body 12 by fulcrum retainers 65 in the valve block 13. The switch actuator 43 extends through the actuator port 22 and then up and over the fluid port 15 to reach the switch 44 which is electrically connected to the solenoid 45.

The dispensing valve 10 having the switch 44 and switch actuator 43 for energizing the solenoid 45, is commonly referred to as an "electric valve".

Figure 10:
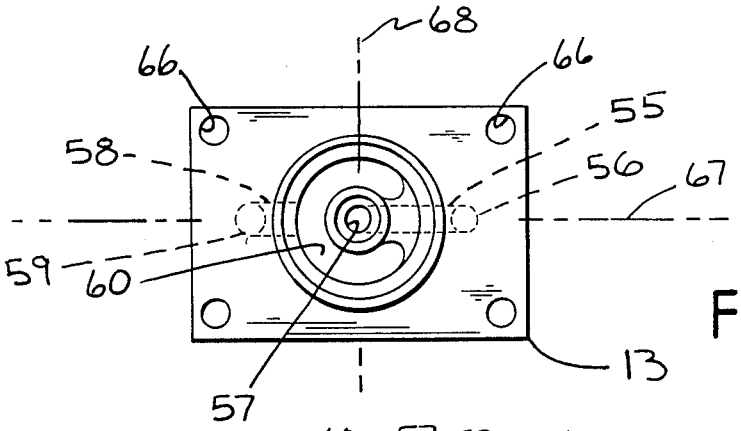
FIG. 10 is an upward looking bottom view of the block of FIG. 8.
Figure 11:
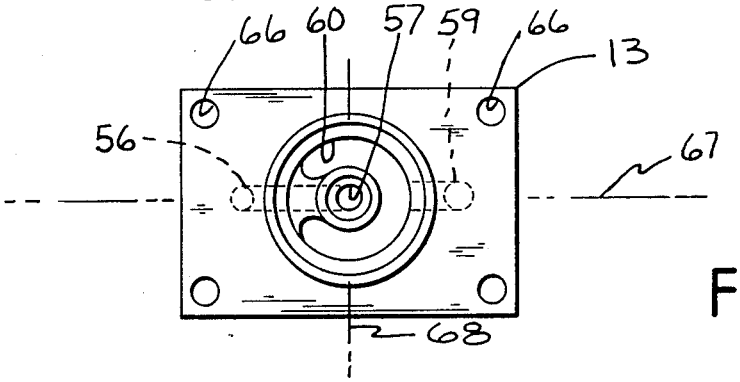
FIG. 11 is a view of the block of FIG. 10 when reversed

FIGS. 8, 9, 10 and 11 show a reversible valve block 13, enabling the dispensing valve 10 to have syrup on either side and water on either side. The block 13 has a syrup port 55 having an inlet 56 leading to a centrally positioned outlet 57 which will register with the middle of nozzle 93, and a water port 58 having an inlet 59 leading to an outlet 60 which will register with the nozzle 93. The syrup port 55 is of a smaller cross-section than the water port 58 and the syrup outlet 57 is positioned centrally inside of and concentrically with the water outlet 60. The outlets 57, 60 are positioned substantially midway between and substantially in a common vertical transverse plane 67 with the inlets 56, 59. Each inlet 56, 59 has an upward facing valve seat 61 and a valve seal pocket 62. On each side of each inlet 56, 59 is a fulcrum 64 providing clearance for pivotal opening movement of the valve actuator 33. Each inlet 56, 59 has a pair of substantially identical fulcrums 64 which oppose each other and which are centered with the respective inlets 56, 59. The block 13 has a pair of fulcrum retainers 65, one on each side of the common plane 67 for retaining the third fulcrum 19 in the main body 12. The block 13 also has a groove 63 for carrying a nozzle seal 97. The block has securement bores 66 through which the shroud screws 40 extend. All of the inlets 56, 59 and outlets 57, 60, valve seats 61, seal pockets 62, groove 63, fulcrums 64, fulcrum retainers 65 and bores 66 are symmetrical about both of the common plane 67 and a midway plane 68 which theoretically passes through the fore-aft centerline of the nozzle 93. This block 13 is reversible end for end on the main body 12. If the block 13 is on the body 12 as shown in FIG. 10, water will be connected to the left port 14 and syrup to the right port 15; if the block 13 is on the body 12 as shown in FIG. 11, syrup will be on the left and water will be on the right. This is assuming the main body 12 is extending downward from the block 13 in FIGS. 10 and 11.

Figure 12:
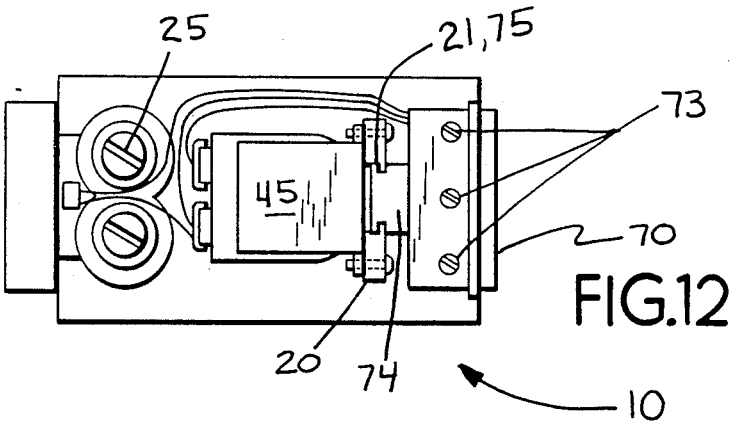
FIG. 12 is a top plan view of the dispensing valve of FIG. 1 with an electronic dispenser control.
Figure 13:
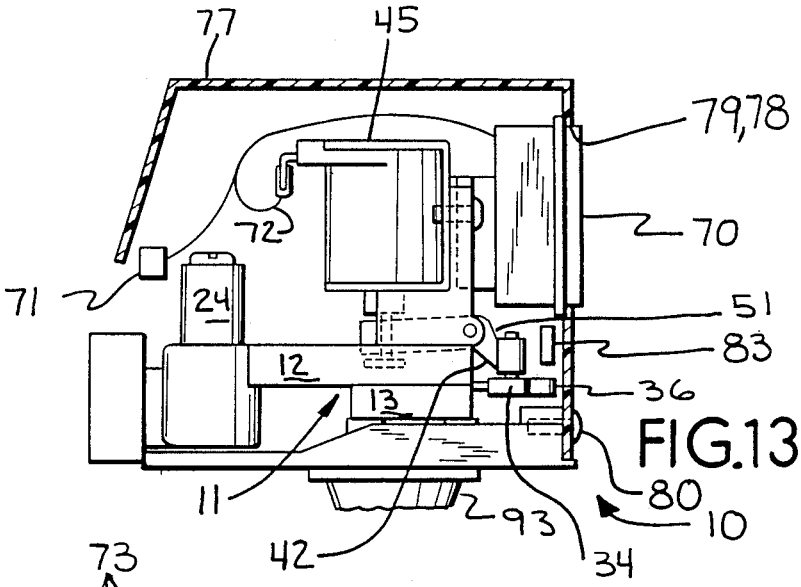
FIG. 13 is a side elevational view of FIG. 12.
Figure 14:
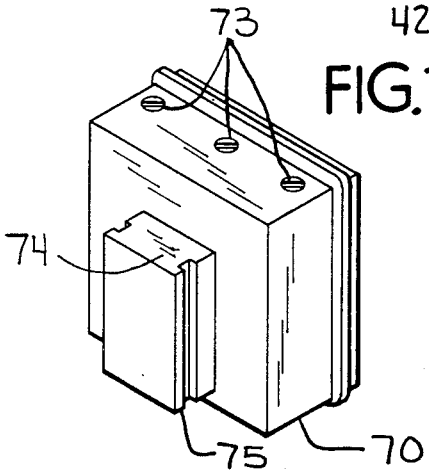
FIG. 14 is a perspective view looking down at the rear side of the electronic control in FIG. 12.
Figure 15:
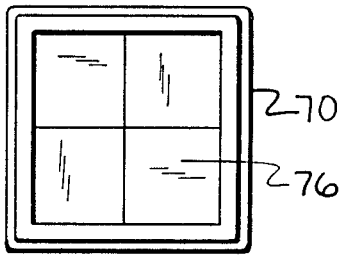
FIG. 15 is a front elevational view of the control of FIG. 14.

FIGS. 12 and 13 show the beverage dispensing valve 10 with the electronic solenoid control 70 as shown in FIGS. 14 and 15. The electronic control 70 has upward facing adjustment screws 73 for small, medium and large portions, and an upright retainer 74 having a pair of tenons 75 that slide downwardly into the mortise 21 of the receiver 21. On the front of the electronic control 70 is a touch switch 76 having a discrete switch in each of its four quadrants; there is one switch each for a small drink, medium drink and large sized drink, and stop dispensing. The electronic control 70 is connectible to a power source (not shown) by a power lead 71 and to the solenoid 45 by a drive lead 72.

The electronic control 70 is used with the beverage dispensing valve 10 as shown in FIGS. 6 and 7 with the solenoid 45 and solenoid actuator 42, but without the switch 44 and switch actuator 43. The electronic control 70 functionally replaces the switch 44 and adds the features of portion control for various sizes and automatic shut-off, and does not require the touch of a cup as actuator 43 does.

The electronic control 70 has a slip-fit in the receiver 20 and is free to slide up and down in the receiver 20. An enclosing and removable valve cover 77 is held on the dispensing valve 10 by a cover screw 80. The cover 77 has an aperture 78 with an upper abutment 79. The electronic control 70 projects through the aperture 78 and is fixed in position in the reciver 20 by the abutment 79. The electronic control 70 is spaced substantially forward of the solenoid 45 for thermal isolation of these elements from each other. The abutment 79 vertically restrains the electronic control 70 so that the tenon 75 is fixed in the mortise 21. When the switch 76 is pressed the cover 77 does not take the pressure load but rather the main body 12 via the receiver 20 withstands the force of pressure upon the switch 76. The portion control adjustment screws 73, which are variable resistors connected to adjust automatic timers in the control 70, are normally enclosed and concealed by the cover 77. The cover 77 is removed by first removing the cover screw 80 and sliding the cover 77 forward and off of the electronic control 70 and then up and off of the dispensing valve 10. The control 70 remains in place with the retainer 74 being in the receiver 20. The adjustment screws 73 are then accessible and manipulable from directly above for adjusting the size of drinks to be dispensed. Replacment of a broken control 70 is done by pulling the broken control 70 up and out of the receiver 20, disconnecting the leads 71, 72 and connecting leads of a new control 70 and lowering the new control 70 into the receiver 20. In the event of power failure, or failure of a control 70 or solenoid 45 and when there are no replacements readily available, the cover 77 and control 70 may be removed and the finger pad 51 may be used as a manual override enabling the dispensing valve 10 to be used until replacement parts are available. The dispensing valve 10 having the electronic control 70 is commonly referred to as a "portion control valve".

Figure 16:
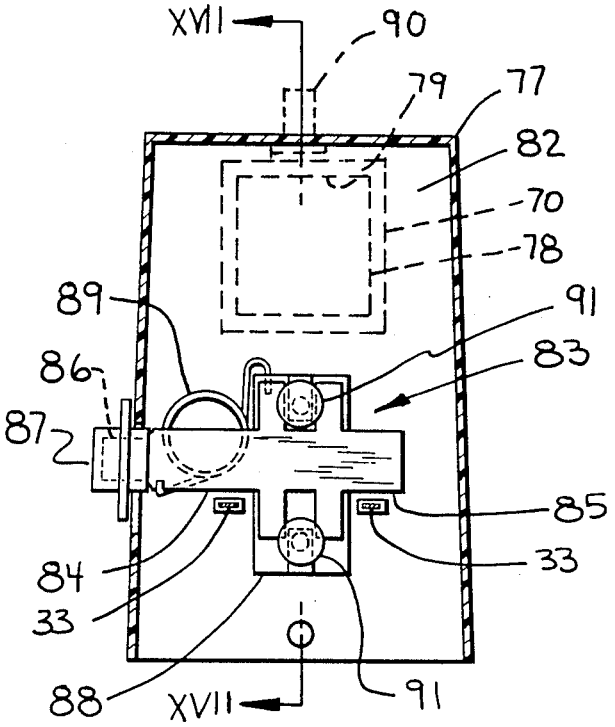
FIG. 16 is a rear elevational view of the inside of a cover for the dispensing valve of FIG. 1, showing an actuator for dispensing only water.
Figure 17:
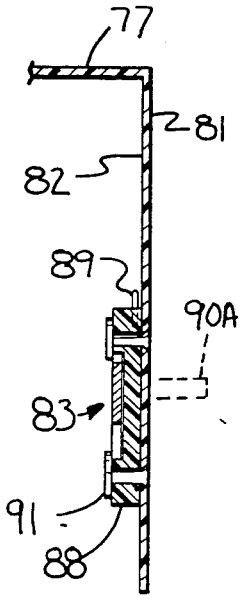
FIG. 17 is a side elevational view taken through FIG. 16.
Figure 18:
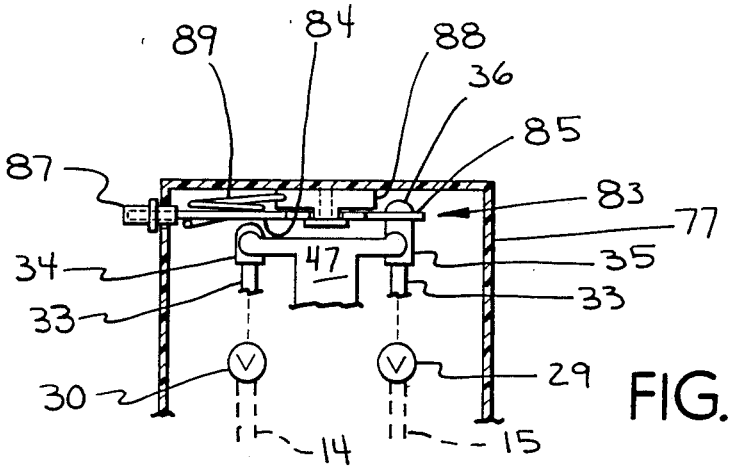
FIG. 18 is a top plan view of the water actuator of FIG. 16

FIGS. 16–18 show an accessory and additional water actuator 83 for manually dispensing water only from the dispensing valve 10. As previously stated, the water anvil 35 has a nose 36 that extends out beyond the syrup anvil 34. The water actuator 83 engages only the nose 36, regardless of whether the water valve 29 is in either of the ports 14, 15.

The water actuator 83 has a first movable abutment 84 and a second movable abutment 85 for engaging the nose 36. A handle 86 has an actuator knob 87 on the outside of the cover 77. The water actuator 83 is movably secured to the cover 77 by a bearing block 88 and fasteners 91. The water actuator 83 is normally pulled upward and out of contact with the nose 36 by a retractor spring 89 which is mounted between the water actuator 83 and the bearing block 88. The bearing block 88 is mounted in between the first and second ports 14, 15 and water and syrup valves 29, 30. The handle 86 extends transversely from the bearing block 88 to the knob 87. The retractor spring 89 is connected to the actuator 83 in between the knob 87 and the first abutment 84 for balancing the actuation and return to normal loads upon the water actuator 83. The water actuator 83 is above the anvils 34, 35 and is movable through a downward path in which both abutments 84, 85 move through an identical path of displacement. Only the nose 36 is engaged by one of the abutments 84, 85; the abutments 84, 85 go downwardly past the syrup anvil 34 and do not make engagement with the syrup anvil 34 because both abutments 84, 85 are forward of the syrup anvil 34 but are in line with the nose 36. The water actuator 83 is independently operable of any common hammer 47. The water actuator 83 can be used with the dispensing valve 10 regardless of type of primary actuator, be it manual 41, switch 43 and solenoid 45, or electronic control 70 and solenoid 45. The water actuator 83 is mounted on the back 82 of a front side 81 of the cover 77, and in FIG. 13 the electronic control 70 is shown mounted on the valve body 11 and projecting through the cover 77 just above the water actuator 83. The control 70, aperture 78 and abutment 79 are shown in dotted lines in FIG. 16. The water actuator 83 ideally lends itself to other forms of a knob 87, such as the top push button 90 of FIG. 16 and/or the front push botton 90A of FIG. 17. As can be observed in FIG. 18 the water valve 29, and anvil 35 with nose 36 are mounted in fluid port 15, which is the left port when observed from the front of the dispensing valve 10. Whereas, in FIGS. 1, 4 and 6, the water valve 29, and anvil 35 with nose 36 are shown in the other fluid port 14, or right port as seen from the front of the dispensing valve 10.

Figure 19:
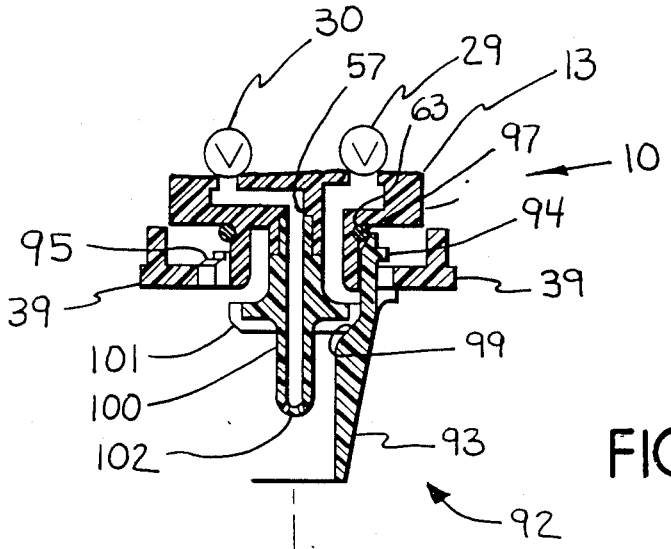
FIG. 19 is an elevational sectional view through the nozzle of the dispensing valve of FIG. 1.
Figure 20:
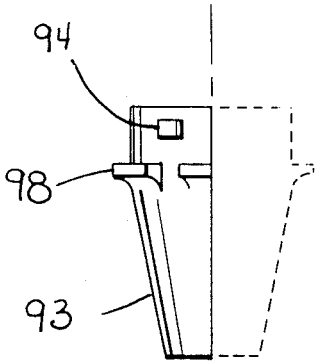
FIG. 20 is an elevational view of the exterior of the nozzle.
Figure 21:
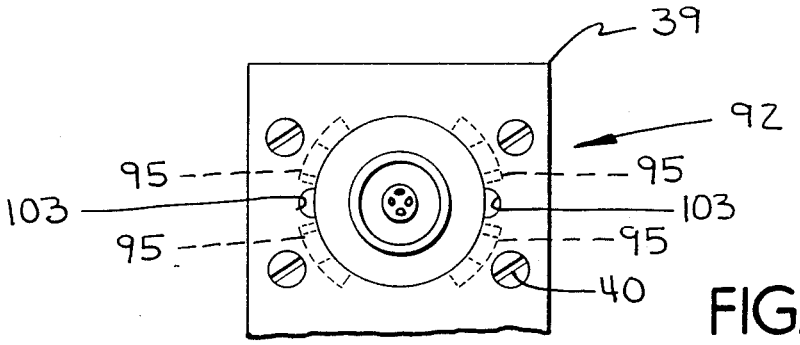
FIG. 21 is a bottom view looking upward at the nozzle.

FIGS. 19–21 show the dispensing outlet 92 and nozzle 93 of the dispensing valve 10. The nozzle 93 has a pair of retainer ears 94 which are insertable upward and through shroud apertures 103. As the nozzle 93 is then turned, the ears 94 are picked up by cams 95 which pull the nozzle 93 up until a concave frusto-conical seal surface 96 fluid tightly engages and seals against an elastomeric seal 97 in the seal groove 63 of the valve block 13 in a combination of a sliding and static seal. There are cams 95 on each side of the shroud apertures 103 and the nozzle 93 may be twisted either way until the ears 94 contact stops on the ends of the cams 95. The sliding seal action of the stationary O-ring seal 97 holds the nozzle 93 from freely turing and falling off of the dispensing valve 10, but at the same time the nozzle 93 is positively retained and cannot fall downward and off. The nozzle 93 has lips 98 under and around from the ears 94. The lips close off the apertures 103 when the nozzle 93 is rotated into its normal position. Inside of the nozzle 93 is a syrup diffuser 100 having abutment legs 101 and a syrup distributor 102. The diffuser 100 is held up and in the syrup outlet 57 by an annular shoulder 99 on the inside of the nozzle 93. The shoulder 99 engages the abutment legs 101 to hold the diffuser 100 up. To remove the nozzle 93 and diffuser 100 for sanitizing, the nozzle 93 is turned until ears 94 register with the apertures 103. The nozzle 93 then falls out and the diffuser 100 can be easily pulled out. After sanitizing, the diffuser 100 is pushed into the syrup outlet 57 and the nozzle 93 is pushed back up and turned to seal and lock. This nozzle 93 and diffuser 100 in combination with the valve block 13, are usable regardless of whether the syrup is in the left or right port 14, 15, and further the nozzle 93 and diffuser 100 are very easy to sanitize and require no tools for removal or installation.

FIGS. 22–25 show a manifold 110 for mounting the dispensing valve 10 and making what is called a quick-disconnect valve. The rear of the main body 12 has a rearward projecting lock pin 115 which has a lock groove 116 adjacent the main body 12. Each of the fluid ports 14, 15 has an inlet end 114 which is half of a fluid quick disconnect, in this case the female half. The manifold 110 is adapted to be mounted to a rigid structure, for example a steel plate on a beverage dispenser (not shown), and has fluid inlets 111 for being connected to sources of pressurized beverage ingredients. The inlets 111 fluidly lead to fluid outlets 112 having normally closed poppet valves 113. The outlets 112 register with the inlets 111 and form the second or male half of fluid quick disconnects. A pivot pin 117 is mounted in the manifold 110 off to one side of the outlets 112 and a latch 118 has a journal 119 pivotally mounted on the pin 117. The latch 118 is flat and has a lock surface 120 for engaging the lock pin groove 116 and a trigger 121 which has a radius just slightly larger than the radius of a human first finger so the trigger 121 is receptive of a human finger without pinching or cutting. On an opposite end of the latch 118 from the journal 119 is a retainer end 122 which is held under a head 124 of a retainer pin 123 mounted in the manifold 110. A hairpin spring 125 best shown in FIG. 26, has a first leg 126 mounted in a spring bore 129 in the manifold 110 and a second leg 127 mounted in a notch 128 adjacent the retainer end 122 of the latch 118. The spring 125 is a U-shaped hairpin and the spring legs 126, 127 are opposed to each other and are one above the other in the spring bore 130 and notch 128. The spring 125 is sandwiched in a recess 130 between the latch 118 and the manifold 110. The latch lock surface 120 is in between the latch journal 119 and the spring notch 128 which multiplies the biasing force exerted upon and by the lock surface 120. Under and behind the lock surface 120 is a bore 131 in the manifold 110 for receiving the lock pin 115. In operation the manifold 110 is fixedly mounted. The valve body 11 is thrust onto the manifold 110. The pin 115 forces the latch 118 up and goes into the bore 131, the disconnect halves 112, 114 go into sealing engagement and the poppet valves 113 are forced open. When the valve body 11 homes in the manifold 110, the latch 118 has its lock surface 120 forced down into the lock groove 156 by the latch spring 125. The lock pin 115, which is in between the fluid ports 14, 15 is held to the manifold 110 together with the valve body 11 by the latch 118 which is held to the manifold on each side of the ports 14, 15 by the pivot pin 117 and retainer pin 123. To release the valve body 11, the user puts a finger into the trigger 121 and pulls the latch 118 up and the valve body 11 and lock pin 115 out; the quick disconnects 112, 114 then automatically close.

Figure 29:
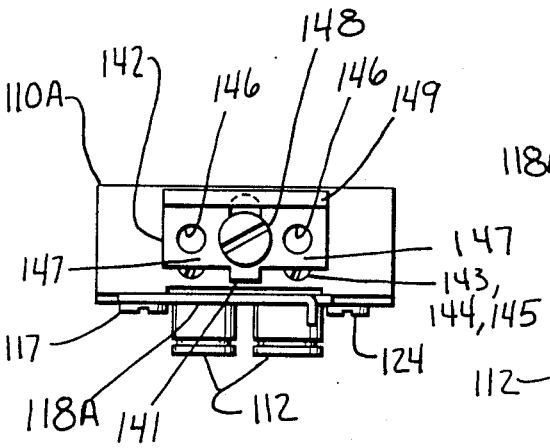
FIG. 29 is a top view of FIG. 28.
Figure 28:
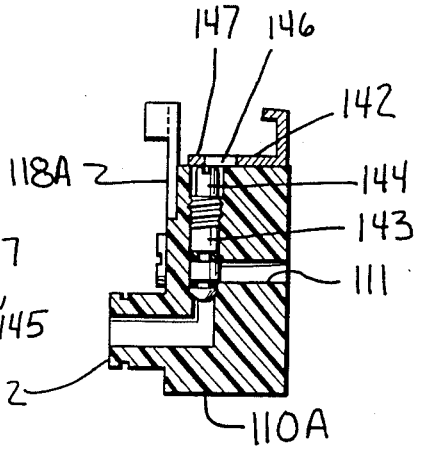
FIG. 28 is a cross sectional elevational view of the manifold of FIG. 27, in an unlocked and closed position.
Figure 31:
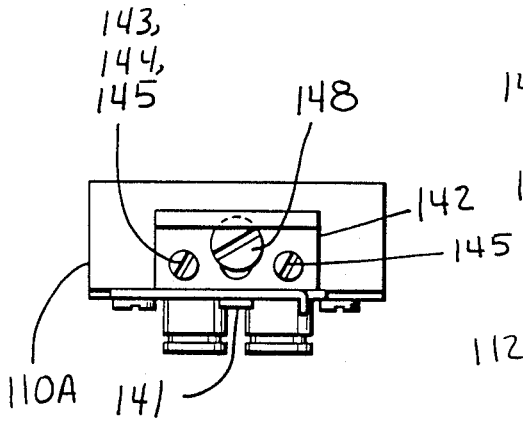
FIG. 31 is a top view of FIG. 30.
Figure 30:
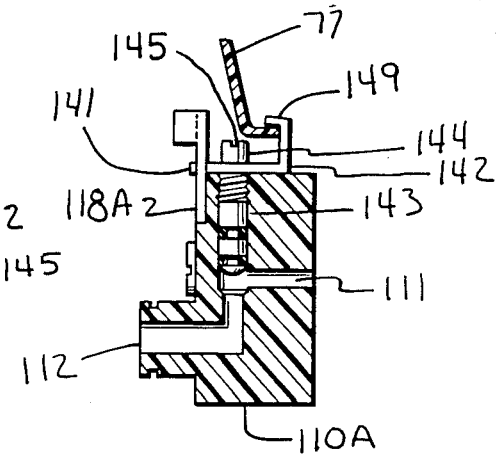
FIG. 30 is a cross-sectional elevational view of the manifold of FIG. 27 in a locked and open position.
Figure 27:
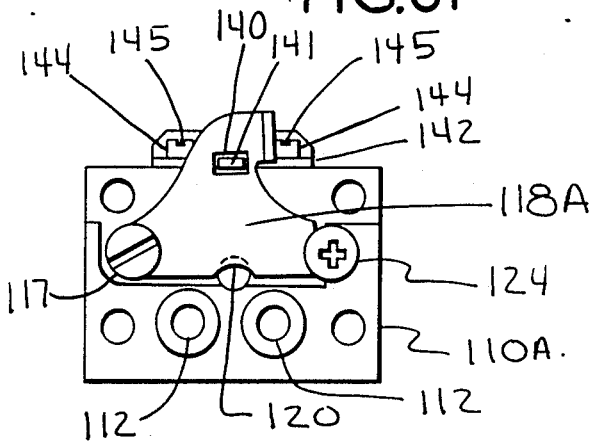
FIG. 27 is a front elevational view of a manifold for mounting and enabling manual disconnect of the dispensing valve of FIG. 1.

FIGS. 27–31 are of an alternative embodiment of a quick disconnect mount for the dispensing valve 10 in which the fluid supplies are positively closed or opened and the latch 118A is positively locked. The manifold 110A has inlets 111 and outlets 112, a pivot pin 117, and a latch 118A having a journal end 122. A retainer pin 123 has a head 124 over the latch retainer end 122. The latch 118A may have a spring notch 128 and the manifold may have a spring bore 129 and a spring 125 may be used although it is not shown and is not necessary. The latch 118A has a lock aperture 140 for receiving a lock bolt 141 on a lock carrier 142 which is slidably mounted on top of the manifold 110A and retained by a headed carrier retainer 148 fastened into the manifold 110A. Within the manifold 110A and in between the fluid inlet and outlets 111, 112 are shut-off valves 143 each having a lockhead 144 which has a screw-head 145 facing upward and which is accessible from above. When the shut-off valves 143 are turned down and in, as in FIG. 28, the water and syrup supplies are closed off; when the shut-off valves are turned out and up as in FIG. 30, the water and syrup supplies are open and the valve body 11 is intended to be on the manifold 110A to receive and control the water and syrup. When the valve body 11 is on the manifold 110A and locked thereto, the latch 118A is down and is locked down by the carrier 142 as shown in FIGS. 30 and 31. The carrier 142 and its lock bolt 141 in latch lock aperture 140 are locked in place by virtue of the shut-off valve lockheads 144 projecting through carrier apertures 146 which only register with the lockheads 144 when the carrier lock bolt 141 is in the latch 118A. The carrier 142 also has a cover retainer 149 which helps to hold the cover 77 onto a dispensing valve 10. FIGS. 28 and 29 show the latch 118A unlocked. To unlock the latch 118A the shut-off valves 143 must be turned down and into a position where they shut off and seal the inlet 111 from the outlet 112 and the lockheads 144 then go down below the carrier 142 and out of the apertures 146 enabling the carrier 142 to be moved rearward until the lock bolt 141 comes out of the latch 118A, enabling the latch 118A to be pivoted upward to release the lock pin 115 and valve body 11 from the manifold 118A.

When the valve body 11 is reinstalled, the latch 118A is pushed down to lock the valve body 11, the carrier 142 is then moved forward to lock the latch 118A. The shut-off valves 143 are then turned up and out to firstly have the lockheads 144 come into the apertures 146 and lock the carrier 142 and then secondly to open the fluid port between the inlet 111 and outlet 112.

The advantages of the dispensing valve 10 are many. It is extremely small and compact. All adjustments are done from the top with a screwdriver. The construction is very strong. The mounting structure is very strong. The valves 10 can be positioned very close to one another. The electronic control 70 can easily be adjusted and changed. Syrup and water can be run in either side and high or low flow rates can be used. All commercialized beverage flow controls can be used in this valve. The valve 10 can be operated even after power failure or electrical component failure. The valve 10 can dispense water only regardless of which side the water is in, and regardless of what type of primary actuator is in the valve. The syrup diffuser 100 and dispensing nozzle 93 are easily sanitized. Quick disconnect structures 110, 110A giving easy and trouble-free function are embodied in the valve 10. The valve 10 gives a much colder random drink than its competitors. The valve 10 isolates its solenoid 45 and armature 46 from beverage ingredients.

Although various minor modifications may be suggested by those versed and experienced in the art, be it understood that I wish to embody within the scope of the patent warranted hereon all such embodiments as reasonably and properly come within the scope of my contribution to the art.

I claim as my invention:

1. An improved detachable beverage dispensing valve, comprising:

(a) a dispensing valve manifold fixedly securable to structure for supporting a beverage valve, said manifold having a fluid inlet leading to a first half of a beverage fluid connector;

(b) a beverage dispensing valve body having a normally closed valve, means for selectively opening said normally closed valve, and a second half of a fluid connector for a beverage line, said second half being fluid tightly connectible to said first half;

(c) a lock pin fixed in and projecting from the rear of the valve body, said lock pin being receivable by the manifold and having means for being locked to the manifold;

(d) a latch movably mounted on said manifold to locking the pin in the manifold and thereby connecting and securing the valve body to the manifold, said latch having a lock surface for lockably engaging the pin, means for manually moving and disengaging the latch, and a latch lock aperture; and (e) a lock carrier movably mounted upon the manifold, said carrier having a latch lock bolt which is movable into and out of the latch lock aperature for selective locking and unlocking of the latch.

2. The improved detachable beverage dispensing valve of claim 1, in which the manifold includes a pair of side by side fluid inlets, a respective pair of connector first valves and a respective pair of shut off valves with there being one shut-off valve for each connector, said lock carrier being slidably mounted to the top of said manifold by a carrier retainer positioned in-between the shut-off valves.

3. The improved detachable beverage dispensing valve of claim 1, in which the manifold includes a pair of side by side fluid inlets, a respective pair of connector first valves and a respective pair of shut-off valves with there being one shut-off valve for each connector, said carrier having a pair of spaced apart lockhead apertures, said shut-off valves each having a lockhead selectively movable into and out of engagement with a respective lockhead aperture, said latch lock aperture and said latch lock bolt being positioned in-between the lockheads and the lockhead engaging apertures.

4. The improved detachable beverage dispensing valve of claim 1, in which the carrier has means for retaining a valve cover to the manifold.

5. The improved detachable beverage dispensing valve of claim 4, in which said cover retaining means also comprises a handle for manual manipulation of the carrier between locking and unlocking positions.

6. The improved detachable beverage dispensing valve of claim 1, in which (a) the latch has a journaled end about which the latch is pivotable and a retainer end spaced from and on an opposite side from the journaled end;

(b) a pivot pin through the journaled end, said pin being transversely positioned off to a first side of the manifold and pivotally securing the latch to the manifold;

(c) a retainer pin fastened to the manifold and transversely positioned off to a second and opposite side of the manifold, said retainer pin having a head under which the latch retainer end is slidably retained; and in which (d) said latch lock surface and said latch lock bolt are both positioned about midway in-between said pivot pin and said retainer pin.

* * * * *